US005249622A

United States Patent [19]

Dalimonte

[11] Patent Number: 5,249,622

[45] Date of Patent: Oct. 5, 1993

[54] RETROFITTED WIDTH ADJUSTING MECHANISM FOR CONTINUOUS CASTING

[75] Inventor: Frank J. Dalimonte, Caledonia, Canada

[73] Assignee: Stelco Inc., Ontario, Canada

[21] Appl. No.: 867,503

[22] Filed: Apr. 13, 1992

[51] Int. Cl.[5] ..... B22D 11/10; B22D 11/00

[52] U.S. Cl. ..... 164/491; 164/420; 164/436; 164/452

[58] Field of Search ..... 164/420, 436, 491, 452, 164/154

[56] References Cited

U.S. PATENT DOCUMENTS

| | | | |
|---|---|---|---|
| 3,717,197 | 2/1973 | Strack et al. | 164/420 |
| 3,838,730 | 10/1974 | Nagaoka et al. | 164/452 |
| 4,523,623 | 6/1985 | Holleis et al. | 164/436 |

FOREIGN PATENT DOCUMENTS

| | | | |
|---|---|---|---|
| 3706720 | 9/1988 | Fed. Rep. of Germany | 164/436 |
| 2534163 | 9/1985 | France . | |

*Primary Examiner*—Mark Rosenbaum
*Assistant Examiner*—Jeffrey T. Knapp
*Attorney, Agent, or Firm*—Shoemaker and Mattare, Ltd.

[57] ABSTRACT

A continuous casting apparatus includes two adjacent continuous casters each with relatively narrow end walls and relatively broad side walls, the end walls being clamped between the side walls. Mechanisms at either end move the respective end walls toward and away from each other, and may also change the slope of the end walls in order to accommodate shrinkage of the metal as it solidifies. The two casters are positioned in alignment and a single tundish is located above them but as close as possible, the tundish being capable of delivering molten metal into both casters simultaneously. The tundish covers and restricts access to the space separating the adjacent ends of the casters. The free end of each caster, however, is accessible, and its respective mechanism can be operated without inconvenience. This invention provides a mechanical linkage interconnecting the control mechanisms at either end of a caster, so that adjustment of the position and orientation of the outer or accessible end wall will cause simultaneous adjustment of the position and orientation of the other end wall that is covered by the tundish.

12 Claims, 3 Drawing Sheets

RETROFITTED WIDTH ADJUSTING MECHANISM FOR CONTINUOUS CASTING

This invention relates generally to continuous casting, and has to do particularly with a method for facilitating the use of continuous casting apparatus by retrofitting a width adjusting mechanism to the apparatus, and the improved apparatus that results from the retrofit.

BACKGROUND OF THIS INVENTION

A typical twin strand continuous casting installation involves the use of two continuous casters located side-by-side and running simultaneously. This arrangement allows a single tundish to be located above the two side-by-side continuous casters, positioned so as to cover about one-half of each continuous caster. The tundish feeds molten metal into both casters.

A typical continuous caster is that shown in French patent 2,534,163, issued Aug. 9, 1985 to Clecim, S. A. In Figure 2 of this French patent is shown a plan view looking down into the continuous casting mold. The Figure shows two long side walls and two short side walls. The short side walls are clamped between the two long side walls. By unclamping the long side walls, the position and angulation of the short side walls can be adjusted. It is common to cool both the short side walls and the large or "long" side walls in order to remove heat from the molten metal. A tundish is located above the mold and has a spout or nozzle delivering molten steel into the space between the long side walls and the short side walls.

Another patent which is representative of the prior art is U.S. Pat. No. 4,523,623, issued to Holleis et al on Jun. 18, 1985.

Conventional continuous caster molds normally include a mechanism at both end walls which includes a threaded drive at the top and another threaded drive at the bottom of the narrow face of the mold. The threaded drives at the top and bottom are interconnected such that when a single shaft is rotated, both of the threaded drives are driven simultaneously. The drives can be uncoupled from one another to allow any desired angling or other adjustment of the end face.

A problem arises in that, for installations of the type described in which two side-by-side continuous casters are fed from a single tundish which overlaps the adjacent end portions of the casters, the tundish tends to be located down closely adjacent the top surfaces of the casters, making it virtually impossible to gain access to the "covered" ends of the casters without moving the tundish. If it is desired to adjust the end walls, then the tundish must first be moved away from the casters, requiring that the whole operation be shut down and that the tundish be emptied. Before it can be used again, the tundish must be relined with refractory material, since the old refractory would be unusable due to being coated with a "skull" of molten metal. In addition yield losses from head and tail crops result when starting and stopping the casting process.

To adjust mold width or taper during casting, present day caster molds or retrofitted caster molds of earlier design are equipped with a drive system for each short side wall. Each drive system is responsible for moving one short side wall or for adjusting its taper.

It is thus clearly desirable, for installations of the kind described, to provide some means by which adjustment of the accessible end wall (the one not covered by the tundish) will automatically cause the non-accessible end wall to be similarly adjusted, and it is an object of one aspect of this invention to provide such means.

It is an object of another aspect of this invention to permit both of the narrow walls of a continuous caster to be adjusted simultaneously while the molding procedure is continuing, thus avoiding the need to shut the system down for adjustment. This advantage is of major importance, because of the very high cost shutting the system down and then starting it up again.

GENERAL DESCRIPTION OF THIS INVENTION

In view of the foregoing, the essential aspect of the present invention is to provide a mechanical interconnection between the two wall-adjusting mechanisms at either end of a continuous caster, whereby adjustment of the position of the accessible end wall entails simultaneous adjustment of the position of the non-accessible end wall.

More particularly, this invention provides, in a continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster, including a rotatable shaft, for moving the respective end wall toward and away from the other end wall, said apparatus being arranged such that the two casters are adjacently positioned end-to-end with their side walls generally aligned, the apparatus further including tundish means above the casters with metal delivery means capable of delivering molten metal into both casters simultaneously, whereby the tundish means covers and restricts access to the space separating the adjacent ends of the casters and to the mechanical means lying between the casters, at least one mechanical means for each caster being at the end of the caster not covered by the tundish means, the improvement comprising, for each caster:

a mechanical linkage interconnecting the mechanical means at either end of the caster, whereby working of the mechanical means not covered by the tundish means, in order to adjust the position of its respective end wall, causes similar working of the mechanical means covered by the tundish means, thus causing simultaneous adjustment of the position of the other end wall.

Further, this invention provides a continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster, including a rotatable shaft, for moving the respective end wall toward and away from the other end wall, while simultaneously adjusting the angulation of the moving end wall, at least one of said mechanical means including a rotatable input shaft adapted to be rotated by a detachable and removable device, said apparatus being arranged such that the two casters are adjacently positioned end-to-end with their side walls generally aligned, the apparatus further including tundish means above the casters with metal delivery means capable of delivering molten metal into both casters simultaneously, whereby the tundish means covers and restricts access to the space separating the adjacent ends of the casters and to the mechanical means lying between the casters, the apparatus further including means for withdrawing and treating continuously cast product from the casters, said at least one mechanical means for each caster being at the end of the caster not covered by the tundish means.

the apparatus further including, for each caster, a mechanical linkage interconnecting the mechanical means at either end of the caster, whereby working of the mechanical means not covered by the tundish means, in order to adjust the position of its respective end wall, causes similar working of the mechanical means covered by the tundish means, thus causing simultaneous adjustment of the position of the other end wall.

Further, this invention provides a method for facilitating the adjustment, during operation, of a continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster, including a rotatable shaft, for adjusting the position of the respective end wall with respect to the other end wall, while simultaneously adjusting the angulation of the moving end wall, at lest one said mechanical means including a rotatable input shaft adjusted to be rotated by a detachable and removable device.

said apparatus being arranged such that the two casters are adjacently positioned end-to-end with their side walls generally aligned, the apparatus further including tundish means above the casters with metal delivery means capable of delivering molten metal into both casters simultaneously, whereby the tundish means covers and restricts access to the space separating the adjacent ends of the casters and to the mechanical means lying between the casters, said at least one mechanical means for each caster being at the end of the caster not covered by the tundish means.

said method comprising the provision, for each caster, of a mechanical linkage interconnecting the mechanical means at either end of the caster, whereby working of the mechanical means not covered by the tundish means, in order to adjust the position of its respective end wall, causes similar working of the mechanical means covered by the tundish means, thus causing simultaneous adjustment of the position of the other end wall.

Finally, this invention provides a method of adjusting, during operation, a continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster, including a rotatable shaft, for moving the respective end wall toward and away from the other end wall, (A)

said apparatus being arranged such that the two casters are adjacently positioned end-to-end with their side walls substantially collinear, the apparatus further including tundish means above the casters with metal delivery means capable of delivering molten metal into both casters simultaneously, whereby the tundish means covers and restricts access to the space separating the adjacent ends of the casters and to the mechanical means lying between the casters, (B)

said method comprising, for each caster, using said device to rotate the rotatable input shaft at the caster end not covered by the tundish means, thereby working the corresponding mechanical means in order to adjust the position of its respective end wall, and using a mechanical linkage interconnecting the mechanical means at either end of the caster to cause similar working of the mechanical means covered by the tundish means, thus causing simultaneous adjustment of the position of the other end wall.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
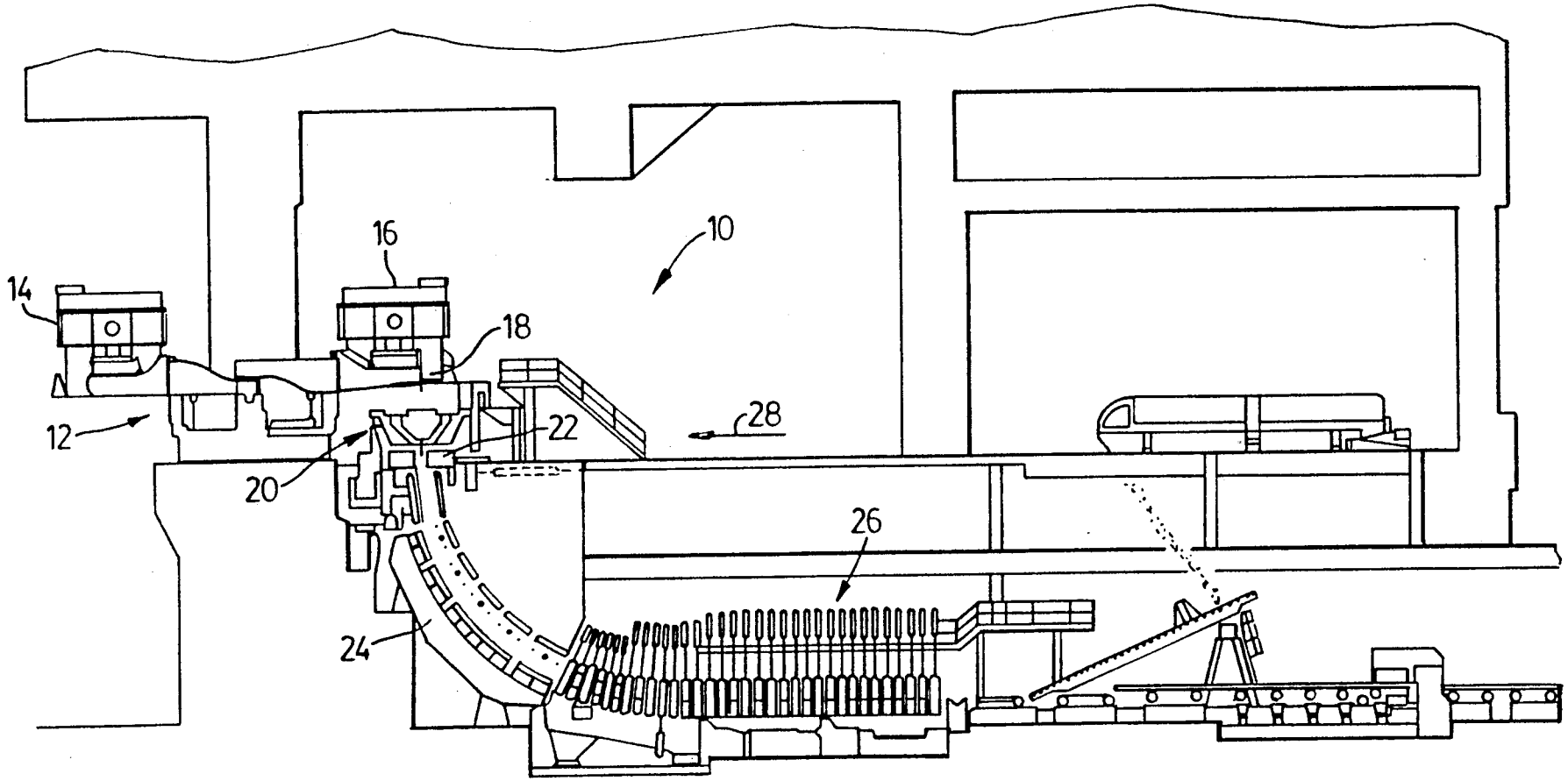
FIG. 1 (PRIOR ART)
FIG. 1 is a somewhat schematic, elevational view of a conventional continuous casting installation of the kind contemplated by this invention.

Attention is first directed to FIG. 1 which illustrates a conventional continuous casting installation generally at 10. The installation 10 includes a ladle turret 12 capable of supporting two diametrically opposed hot metal ladles 14 and 16. The ladle turret 12 is adapted to rotate about a vertical axis, between positions which are 180° apart, so that (for example) while one hot metal ladle (16) is located above the continuous caster, a newly filled hot metal ladle (14) can be loaded into the turret at a location spaced leftwardly from the continuous caster. The hot metal ladle 16 has a pouring spout 18, beneath which is located a tundish 20 which is situated above two aligned continuous casting molds 22.

Each continuous casting mold 22 delivers a continuous, solidified bar of the metal downwardly into a respective spray chamber 24 which typically curves the path of the continuously cast bar so that eventually the bar is moving horizontally through a withdrawal straightener 26. From the withdrawal straightener 26, the bar passes rightwardly to one of various possible further operations that do not relate in any way to the present invention. These may include: mandrelless downcoiling, cutting into specific lengths, or a roller mill to reduce the thickness of the bar and increase its length.

Figure 3:
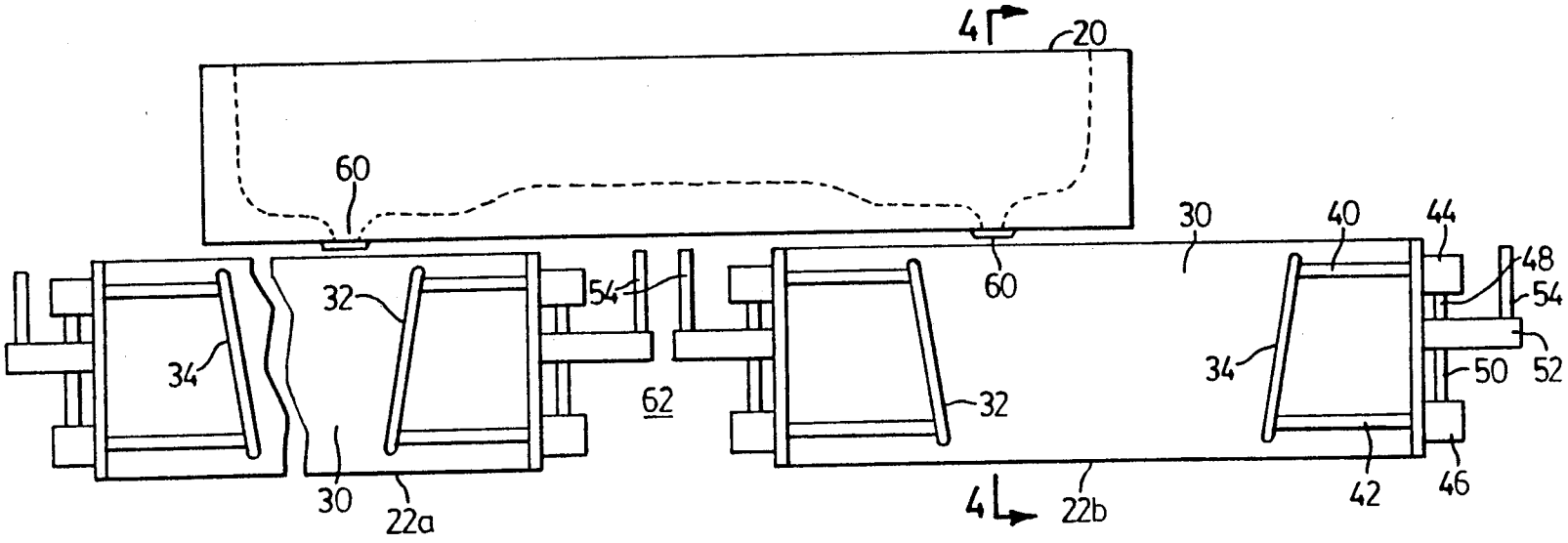
FIG. 3 (PRIOR ART)
FIG. 3 is schematic view of the prior art arrangement of a twin caster.

Attention is now directed to FIG. 3, which is a schematic view of a portion of the FIG. 1 apparatus, seen looking in the direction of the arrow 28.

In FIG. 3, the tundish 20 is seen in side elevation, the tundish straddling and thus covering the adjacent ends of two aligned continuous casters 22*a* and 22*b*. Each of the casters has two spaced-apart side walls 30 (only one seen in the schematic view of FIG. 3), and two spaced-apart, movable end walls 32 and 34 which are adapted to be clamped between the side walls 30 and 31.

Figure 4:
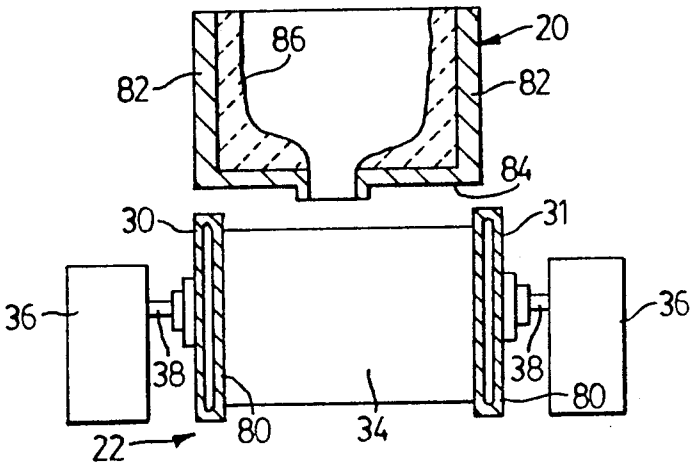
FIG. 4 (PRIOR ART)
FIG. 4 is a view taken at the line 4—4 in FIG. 3.

Means are provided for causing the side walls 30, 31 selectively (1) to exert compressive inward pressure on the end walls 32 and 34 to clamp them in position, or (2) to relieve such compressive pressure in order to allow the position of the end walls to be adjusted. In FIG. 4, the components 36 to either side of the continuous caster 22 control the inward pressure exerted by the end walls 30 and 31 through shafts 38. In a variant of this design, one of the side walls (30, 31) can remain stationary while the other side wall moves toward and away from it to exert and relieve clamping pressure.

Mechanical means are provided at either end of each caster 22, for moving the respective end wall 32 or 34. The mechanical means also is capable of causing the respective end walls to assume different oblique orientations, based on the shrinkage rate of the molten metal as it solidifies.

Attention is directed to FIG. 3, the right end thereof, for a description of the specific mechanical means at the rightward end of the rightward caster, it being understood that the same mechanical means is provided at either end of both casters.

In FIG. 3, an upper horizontal shaft 40 and a lower horizontal shaft 42 represent rotary position-adjusting means by which the rightward end wall 34 can be moved both in rotation and in translation. In other words, the end wall 34 can be moved toward and away from the other end wall 32 while simultaneously changing its angulation, or without changing its angulation. Usually however, since the angulation of the end walls 32 and 34 is provided to accommodate the shrinkage of the melt as it solidifies, such angulation would be controlled as a function of the end wall position, so that the decrease in the dimension of the continuously cast material from the top of the end walls to the bottom of the end walls is always approximately 0.9%. In other words, the distance between the bottom ends of the end walls 32 and 34 typically remains at about 99% of the distance between the upper ends thereof, regardless of the left-right positions of the end walls.

The threaded means represented by the shafts 40 and 42 are controlled by screw jacks 44 and 46, which receive respective rotary inputs along the shafts 48 and 50. The consistent taper of the end walls referred to earlier is achieved by the screw jacks 44 and 46 being of slightly different gear ratios such that equal input rotation to each screw jack will result in slightly different movement of the narrow face travel, thereby allowing the taper to be self adjusting based on width, thereby resulting in the desired constant 0.9% (of width) taper.

Both of the shafts 48 and 50 are driven from a further gear box 52 which receives input from a rotatable upright shaft 54. The conventional operation of the apparatus shown in FIG. 3 involves either the manual rotation of the shaft 54 using a wrench or ratchet, or the powered rotation of the shaft 54 utilizing a portable drive gun with means for engaging the upright shaft 54, while the compressive inward pressure exerted by the side walls 30 and 31 is relieved, thus changing the position of the respective end wall.

With reference to FIGS. 3 and 4, it will be noted that the two casters 22*a* and 22*b* are adjacently position end-to-end with their side walls substantially collinear, and that the tundish 20 is located above the casters 22*a* and 22*b* with metal delivery nozzles 60 adapted to deliver molten metal from the tundish simultaneously into both caster 22*a* and 22*b*. It will be particularly noted in FIG. 3 that the tundish 20, because it must be located as close as possible to the continuous casters (in order to restrict splashing of the molten metal), covers and restricts access to the region 62 which lies between the adjacent ends of the casters, and which contains the mechanical means for adjusting the end walls 32, including the rotatable control shafts 54.

Figure 2:
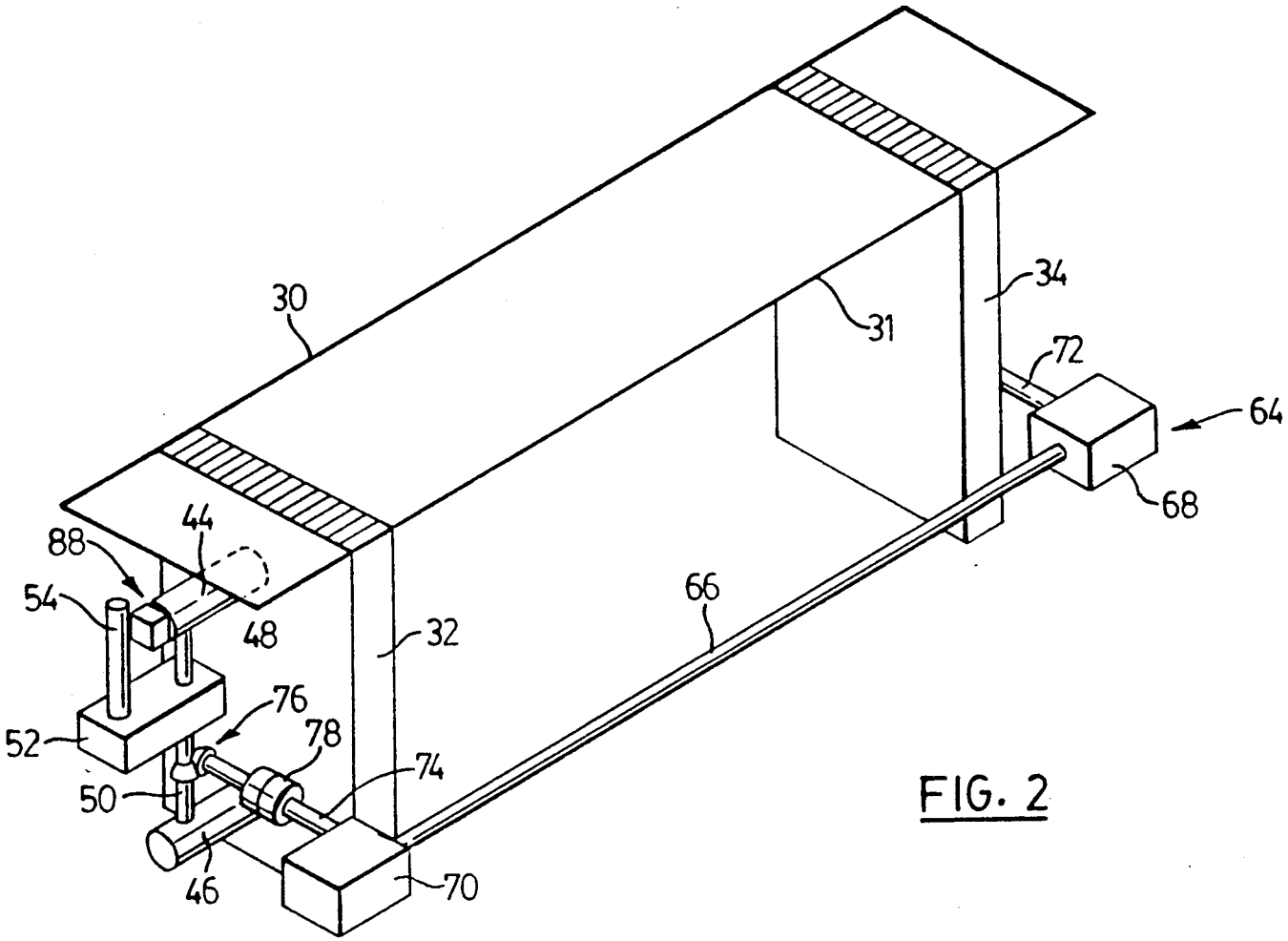
FIG. 2 is a perspective view of a continuous casting machine, to which the apparatus of this invention has been retrofitted.

Attention is now directed to FIG. 2, which shows the improvement offered by the present invention. The improvement includes, for each caster 22*a*, 22*b*, a mechanical linkage 64 interconnecting the mechanical means at either end of each caster, whereby working of the mechanical means which is not covered by the tundish 20, in order to adjust the position and taper of its respective end wall, causes similar working of the mechanical means at the other end, which is covered by the tundish means, thus bringing about simultaneous adjustment of the position and taper of the other end wall.

More particularly, the mechanical linkage 64 can be seen in FIG. 2 to include a longitudinal shaft 66 which is a) operatively connected at the rightward end to a first right angle gear drive 68 which is located adjacent the respective mechanical means for controlling the position of the end wall 34, and b) operatively connected at the other end to a second right angle gear drive 70 adjacent the other mechanical means (that illustrated at the left in FIG. 2). A first transverse shaft 72 operatively connects the first gear drive 68 and the adjacent mechanical means, while a second transverse shaft 74 operatively connects the right angle gear drive 70 with the mechanical means which is visible in FIG. 2 at the left.

Even more specifically, as seen in FIG. 2, the transverse shaft 74 is connected through bevel gears 76 with the upright shaft 50 which extends between the synchronizing gear box 52 and the screw jack 46. Also, the transverse shaft 74 includes a quick disconnect coupling 78 of known type, which can be disconnected in order to isolate the longitudinal shaft 66 from the respective control mechanism for the end wall 32. Preferably, the other transverse shaft 72 also has a quick disconnect coupling, but this is hidden in the view of FIG. 2. Disconnecting either of the couplings will isolate the one end wall from the other (32, 34), and allow each wall to be independently adjusted.

Preferably, the bevel gears 76 and each right angle gear drive 68, 70 have a gear ratio of 1:1.

With reference to FIG. 4, it can be clearly seen that each of the side walls 30 and 31 has an internal cavity 80 through which a cooling fluid like water can be circulated. Also in FIG. 4, the tundish 20 is seen to include external side walls 82 and a bottom wall 84. The tundish 20 is lined with a refractory material 86, in accordance with standard practice.

One of the primary advantages of the invention set forth above relates to cost. If a continuous casting mold, of the kind here contemplated, were to be retrofitted with one or two electric motors and the necessary power transmission and speed reduction components at both end walls, the total retrofit would cost an estimated 3.2 million dollars for a complement of 8 molds. By contrast, the provision of a mechanical linkage between the mechanical control means at either end of a caster mold, as set forth in the appended claims, would represent a total cost of only about $135,000.00 for a complement of 8 molds.

As seen in FIG. 2, an encoder 88 is provided on the upper screw jack 44. The encoder measures the total travel of the respective wall end 32, 34, and its output is shown on a digital display (not shown).

While the transverse shaft 74 is shown to be connected, through bevel gears 76, to the upright shaft 50, it will be understood that the connection could be made to the input shaft 54, or the other drive shaft 48.

In the appended claims, reference is made to mechanical means at each end of the caster, each mechanical means including a rotatable shaft. It will be evident that this "rotatable shaft" could be any of the three shafts 48, 50 or 54 shown in FIG. 2.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster for moving the respective end wall toward and away from the other end wall, while simultaneously adjusting the angulation of the moving end wall, at least one said mechanical means including a rotatable input shaft adapted to be rotated by a detachable and removable device, said apparatus being arranged such that the two casters are adjacently positioned end-to-end with their side walls generally aligned, the apparatus further including tundish means above the casters with metal delivery means capable of delivering molten metal into both casters simultaneously, whereby the tundish means covers and restricts access to the space separating the adjacent ends of the casters and to the mechanical means lying between the casters, said at least one mechanical means for each caster being at the end of the caster not covered by the tundish means, and further comprising, for each caster:

a mechanical linkage interconnecting the mechanical means at either end of the caster, whereby working of the mechanical means not covered by the tundish means, in order to adjust the position of its respective end wall, causes similar working of the mechanical means covered by the tundish means, thus causing simultaneous adjustment of the position of the other end wall.

2. The apparatus claimed in claim 1, in which the mechanical linkage for each caster comprises a longitudinal shaft operatively connected at one end to a first right angle gear drive adjacent one of the rotatable shafts and operatively connected at the other end to a second right angle gear drive adjacent the other rotatable shaft, a first transverse shaft operatively connected between the first gear drive and said one of the rotatable shafts, and a second transverse shaft operatively connected between the second gear drive and said other rotatable shaft.

3. The apparatus claimed in claim 2, in which each transverse shaft includes a quick disconnect coupling whereby the respective transverse shaft can be isolated from the longitudinal shaft.

4. The apparatus claimed in claim 2, in which each transverse shaft is coupled to its respective rotatable shaft through a set of bevel gears.

5. The apparatus claimed in claim 4, in which the gear ratio of each bevel gear set and of each gear box is 1:1.

6. A continuous casting apparatus for molten metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster for moving the respective end wall toward and away from the other end wall, while simultaneously adjusting the angulation of the moving end wall, at least one said mechanical means including a rotatable input shaft adapted to be rotated by a detachable and removable device, said apparatus being arranged such that the two casters are adjacently positioned end-to-end with their side walls generally aligned, the apparatus further including tundish means above the casters with metal delivery means capable of delivering molten metal into both casters simultaneously, whereby the tundish means covers and restricts access to the space separating the adjacent ends of the casters and to the mechanical means lying between the casters, the apparatus further including means for withdrawing and treating continuously cast product from the casters, said at least one mechanical means for each caster being at the end of the caster not covered by the tundish means, the apparatus further including, for each caster, a mechanical linkage interconnecting the mechanical means at either end of the caster, whereby working of the mechanical means not covered by the tundish means, in order to adjust the position of its respective end wall, causes similar working of the mechanical means covered by the tundish means, thus causing simultaneous adjustment of the position of the other end wall.

7. The apparatus claimed in claim 6, in which which the mechanical linkage for each caster comprises a longitudinal shaft operatively connected at one end to a first right angle gear drive adjacent one of the rotatable shafts and operatively connected at the other end to a second right angle gear drive adjacent the other rotatable shaft, a first transverse shaft operatively connected between the first gear drive and said one of the rotatable shafts, and a second transverse shaft operatively connected between the second gear drive and said other rotatable shaft.

8. The apparatus claimed in claim 7, in which each transverse shaft includes a quick disconnect coupling whereby the respective transverse shaft can be isolated from the longitudinal shaft.

9. The apparatus claimed in claim 7, in which each transverse shaft is coupled to its respective rotatable shaft through a set of bevel gears.

10. The apparatus claimed in claim 9, in which the gear ratio of each bevel gear set and of each gear box is 1:1.

11. A method for facilitating the adjustment, during operation, of a continuous casting apparatus for melted metal, the apparatus including two adjacent continuous casters, each caster having:

a) two spaced-apart side walls, b) two spaced-apart, movable end walls adapted to be clamped between said side walls.

c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster for moving the respective end wall toward and away from the other, while simultaneously adjusting the angulation of the moving end wall, at least one said mechanical means including a rotatable input shaft adapted to be rotated by a detachable and removable device, said apparatus being arranged such that the two casters are adjacently positioned end-to-end with their side walls substantially collinear, the apparatus further including tundish means above the casters with metal delivery means capable of delivering molten metal into both casters simultaneously, whereby the tundish means covers and restricts access to the space separating the adjacent ends of the casters and to the mechanical means lying between the casters, said at least one mechanical means for each caster being at the end of the caster not covered by the tundish means, said method comprising rotating the rotatable input shaft of each caster at the caster end not covered by the tundish means, thereby working the corresponding mechanical means in order to adjust the position of its respective end wall, and using a mechanical linkage interconnecting the mechanical means at either end of the caster to cause similar working of the mechanical means covered by the tundish means, and simultaneously adjusting the position of the other end wall.

12. A method of adjusting, during operation, a continuous casting apparatus for melted metal, the apparatus including two adjacent continuous casters, each caster having:

a) two spaced-apart side walls, b) two spaced-apart, movable end walls adapted to be clamped between said side walls, c) means for causing the side walls selectively 1) to exert compressive inward pressure on the end walls to clamp said end walls in position or 2) to relieve such compressive pressure in order to allow the position of the end walls to be adjusted, d) mechanical means at each end of the caster for moving the respective end wall toward and away from the other, while simultaneously adjusting the angulation of the moving end wall, at least one said mechanical means including a rotatable input shaft adapted to be rotated by a detachable end removable device, said apparatus being arranged such that the two casters are adjacently positioned end-to-end with their side walls substantially collinear, the apparatus further including tundish means above the casters with metal delivery means capable of delivering molten metal into both casters simultaneously, whereby the tundish means covers and restricts access to the space separating the adjacent ends of the casters and to the mechanical means lying between the casters, said at least one mechanical means for each caster being at the end of the caster not covered by the tundish means, said method comprising rotating the rotatable input shaft of each caster at the caster end not covered by the tundish means, thereby working the corresponding mechanical means, in order to adjust the position of its respective end wall, and using a mechanical linkage interconnecting the mechanical means at either end of the caster to cause similar working of the mechanical means covered by the tundish means, and simultaneously adjusting the position of the other end wall.

* * * * *